US010006656B1

(12) United States Patent
Parks

(10) Patent No.: US 10,006,656 B1
(45) Date of Patent: Jun. 26, 2018

(54) DISPENSER APPARATUS AND METHOD

(71) Applicant: Steve A. Parks, Georgetown, TX (US)

(72) Inventor: Steve A. Parks, Georgetown, TX (US)

( * ) Notice: Subject to any disclaimer, the term of this patent is extended or adjusted under 35 U.S.C. 154(b) by 0 days. days.

(21) Appl. No.: 15/386,247

(22) Filed: Dec. 21, 2016

Related U.S. Application Data

(60) Continuation-in-part of application No. 14/753,314, filed on Jun. 29, 2015, now abandoned, which is a division of application No. 13/901,898, filed on May 24, 2013, now Pat. No. 9,289,803.

(51) Int. Cl.
*F16K 3/36* (2006.01)
*F24F 13/22* (2006.01)
*B08B 9/032* (2006.01)

(52) U.S. Cl.
CPC ..... *F24F 13/222* (2013.01); *B08B 9/0325* (2013.01); *B08B 9/0328* (2013.01); *F24F 2013/227* (2013.01); *F24F 2221/225* (2013.01); *Y10T 137/86131* (2015.04)

(58) Field of Classification Search
CPC ..... F24F 13/222; F24F 2013/227; F24F 2221/225; B08B 9/0325; B08B 9/032; B08B 9/0321; B08B 9/0328; Y10T 137/86131
See application file for complete search history.

(56) References Cited

U.S. PATENT DOCUMENTS 3,677,285 A 7/1972 Adams
3,884,265 A * 5/1975 Fry ..... A47L 15/30 134/157
5,514,344 A 5/1996 D'Agaro
5,674,323 A * 10/1997 Garcia ..... B08B 3/12 134/1
5,853,014 A 12/1998 Rosenauer
5,975,113 A 11/1999 Haining et al.
6,041,611 A 3/2000 Palmer
6,581,625 B1 6/2003 Arai
6,708,717 B1 3/2004 Coogle
6,892,907 B2 5/2005 Varney
7,293,675 B1 11/2007 Luhn
7,392,658 B1 7/2008 Hardy, III
7,857,004 B2 12/2010 Pearson
8,075,769 B1 12/2011 Gleason et al.
8,961,708 B2 2/2015 Kaiser
9,289,803 B1 3/2016 Parks
2003/0010381 A1 1/2003 Kimbrough
(Continued)

FOREIGN PATENT DOCUMENTS

JP 4052499 2/1992
JP 2008095996 4/2008

*Primary Examiner* — Jessica Cahill
(74) *Attorney, Agent, or Firm* — Dennis D. Brown; Brown Patent Law, P.L.L.C.

(57) ABSTRACT

A dispenser and procedure for disinfecting and cleaning air conditioner condensation drainage lines and other condensation drainage lines. The dispenser can be installed at any convenient location on any floor of a home or other building, regardless of whether the location is below, above, or at the same elevation as the inlet of the condensation drainage line. The dispenser includes a liquid pump for delivering an amount of treatment fluid into a treatment delivery line and an air pump for pushing the dose of treatment fluid through the treatment delivery line and into the condensation drainage line.

12 Claims, 6 Drawing Sheets

(56) References Cited

U.S. PATENT DOCUMENTS

| | | | | |
|---|---|---|---|---|
| 2004/0065347 | A1 | 4/2004 | Awad | |
| 2007/0227504 | A1 | 10/2007 | Carroll | |
| 2008/0017249 | A1 | 1/2008 | Hsu | |
| 2008/0047614 | A1 | 2/2008 | Hammonds | |
| 2011/0061745 | A1 | 3/2011 | Pearson | |
| 2013/0092758 | A1* | 4/2013 | Tanaka | B60S 1/52<br>239/284.1 |
| 2013/0306163 | A1 | 11/2013 | Hubbard | |
| 2014/0338758 | A1 | 11/2014 | Oakner | |
| 2015/0059807 | A1 | 3/2015 | Behle | |
| 2015/0183406 | A1 | 7/2015 | Tanaka | |
| 2016/0037963 | A1* | 2/2016 | Tuchrelo | A47J 31/60<br>222/148 |
| 2017/0079469 | A1* | 3/2017 | Apone | A47J 31/4489 |
| 2017/0088410 | A1* | 3/2017 | Wing | B67D 1/0022 |
| 2017/0129760 | A1* | 5/2017 | Aneson | B67D 1/07 |

* cited by examiner

DISPENSER APPARATUS AND METHOD

CROSS-REFERENCE TO RELATED CASES

This application is a continuation-in-part application of co-pending U.S. patent application Ser. No. 14/753,314 filed Jun. 29, 2015, which was a divisional of U.S. patent application Ser. No. 13/901,898, filed May 24, 2013, now U.S. Pat. No. 9,289,803, the disclosures of which are incorporated herein by reference as if fully set out at this point.

FIELD OF THE INVENTION

The present invention relates to apparatuses and methods for disinfecting, cleaning, clearing, and/or otherwise treating condensation drainage lines for air conditioning units and other systems.

BACKGROUND OF THE INVENTION

A need exist for an improved device and procedure for more effectively disinfecting, cleaning, and/or clearing air conditioner condensation drainage lines installed in homes, offices and other buildings. If left untreated, air conditioner condensation drainage lines can present ideal conditions for the growth and build-up of bacteria, algae, mold, and mildew and are also prone to collecting dust, insulation fibers, and other debris commonly present in attics and in similar environments. Untreated condensation drainage lines therefore not only present a significant health risk, but are also susceptible to clogging and overflow.

Unfortunately, the systems currently available in the art for treating air conditioner condensate drainage lines have several shortcomings and disadvantages. For example, to (a) allow gravity flow of the treatment fluid into the condensate drainage line, (b) avoid excessive cost, and (c) limit the amount of fluid required per treatment, it has commonly been necessary that the treatment system be installed in the same room where the air conditioning/heater system is also located, i.e., typically the user's attic. As a result, the user has been required to carry heavy items and materials up a ladder or up a set of stairs and to spend a considerable amount of time in the attic, not only when installing the treatment system, but also when refilling or replacing the treatment fluid and when operating the system.

Of course, in addition to being difficult to reach, especially when carrying heavy items or materials, attics are typically very hot in the summertime and commonly present serious hazards such as, for example, inadequate flooring, no flooring at all, exposed nails which extend through the roof, etc. Consequently, the attic is usually the most uncomfortable and unsafe area in the home and often cannot even be reached by the elderly or by individuals who are injured or disabled.

SUMMARY OF THE INVENTION

The present invention provides a dispenser apparatus and method which satisfy the needs and alleviate the problems discussed above. In addition to being effective, efficient, simple to maintain, simple to operate, and low cost, the inventive dispenser can be installed (a) at ground level (e.g., in a garage), (b) in the attic with the air conditioning/heating system, or (c) in any other room on any floor or level of the building. In other words, the inventive dispenser can be installed anywhere, regardless of whether it is above, below, or at the same elevation as the air conditioner condensation drip pan or the inlet of the condensate drainage line.

In one aspect, there is provided a dispenser apparatus for treating a condensate drainage line comprising: a container for a treatment fluid; a liquid pump having an inlet for receiving the treatment fluid from the container, the liquid pump also having a discharge for delivering the treatment fluid to a treatment delivery line; and an air pump having a discharge for delivering air to the treatment delivery line.

The inventive dispenser apparatus preferably also comprises a control device which is in electronic communication with the liquid pump and the air pump. The control device preferably has programmed instructions stored therein such that the control device will operate to (a) activate the liquid pump to deliver an amount of the treatment fluid into the treatment delivery line and then (b) activate the air pump to discharge an amount of air sufficient to push the amount of the treatment fluid through the treatment delivery line. In addition, the inventive dispenser apparatus preferably further comprises a manual actuator electronically linked to the control device to cause the control device to operate in accordance with its programmed instructions.

In another aspect, there is provided a method of treating a condensation drainage line. The method comprises the steps of (a) positioning the outlet end of the treatment delivery line of a dispenser apparatus such that the treatment delivery line will deliver a treatment fluid to the condensation drainage line and (b) dispensing an amount of the treatment fluid from the dispenser apparatus to the condensation drainage line. The dispenser apparatus used in the method preferably comprises: a container for the treatment fluid; a liquid pump having an inlet for receiving the treatment fluid from the container, the liquid pump also having a discharge for delivering the treatment fluid to the treatment delivery line; and an air pump having a discharge for delivering air to the treatment delivery line.

In step (b) of the inventive method, the amount of the treatment fluid is preferably dispensed from of the dispensing apparatus to the condensation drainage line by the steps of: (i) activating the liquid pump to deliver the amount of the treatment fluid into the treatment delivery line and then (ii) activating the air pump to discharge an amount of air sufficient to push the amount of the treatment fluid through the treatment delivery line to the condensation drainage line.

In another aspect of the inventive method wherein the delivery point for delivering the treatment fluid to the condensation drainage line in step (b) is located at an upper elevation, the inventive method can include the additional steps, prior to step (a), of (i) mounting the dispenser apparatus at a lower elevation which is below the upper elevation and (ii) extending the treatment delivery line from the dispenser apparatus at the lower elevation to the delivery point at the upper elevation. By way of example, the treatment fluid delivery point can be located in an attic or upper floor of a building and the dispenser apparatus can optionally be mounted in step (i) in a different floor of the building which is elevationally lower than the attic or upper floor.

Further aspects, features, and advantages of the present invention will be apparent to those of ordinary skill in the art upon examining the accompanying drawings and upon reading the following Detailed Description of the Preferred Embodiments.

DETAILED DESCRIPTION OF THE PREFERRED EMBODIMENTS

Figure 1:
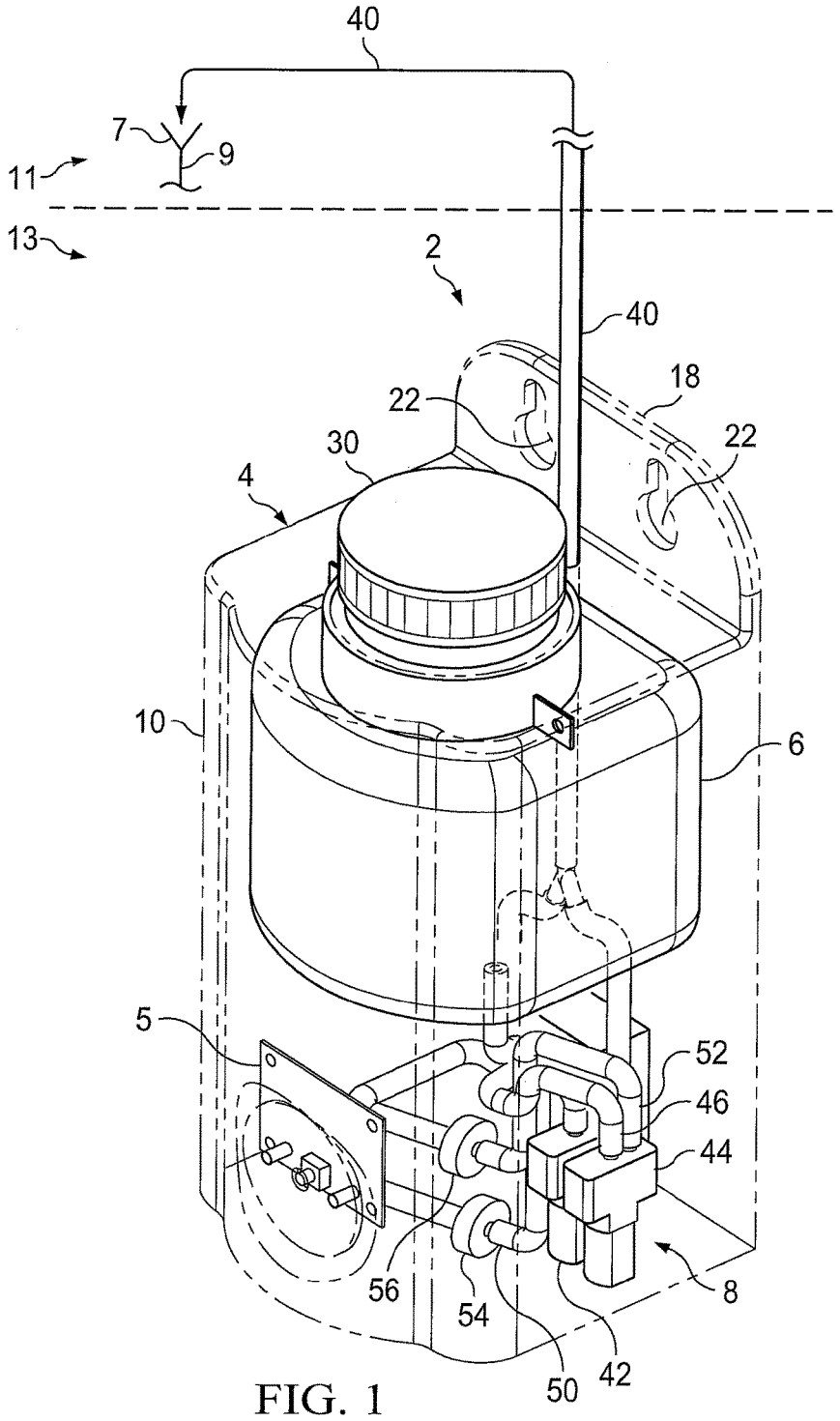
FIG. 1 is a front perspective view of an embodiment 2 of the dispenser apparatus provided by the present invention.
Figure 2:
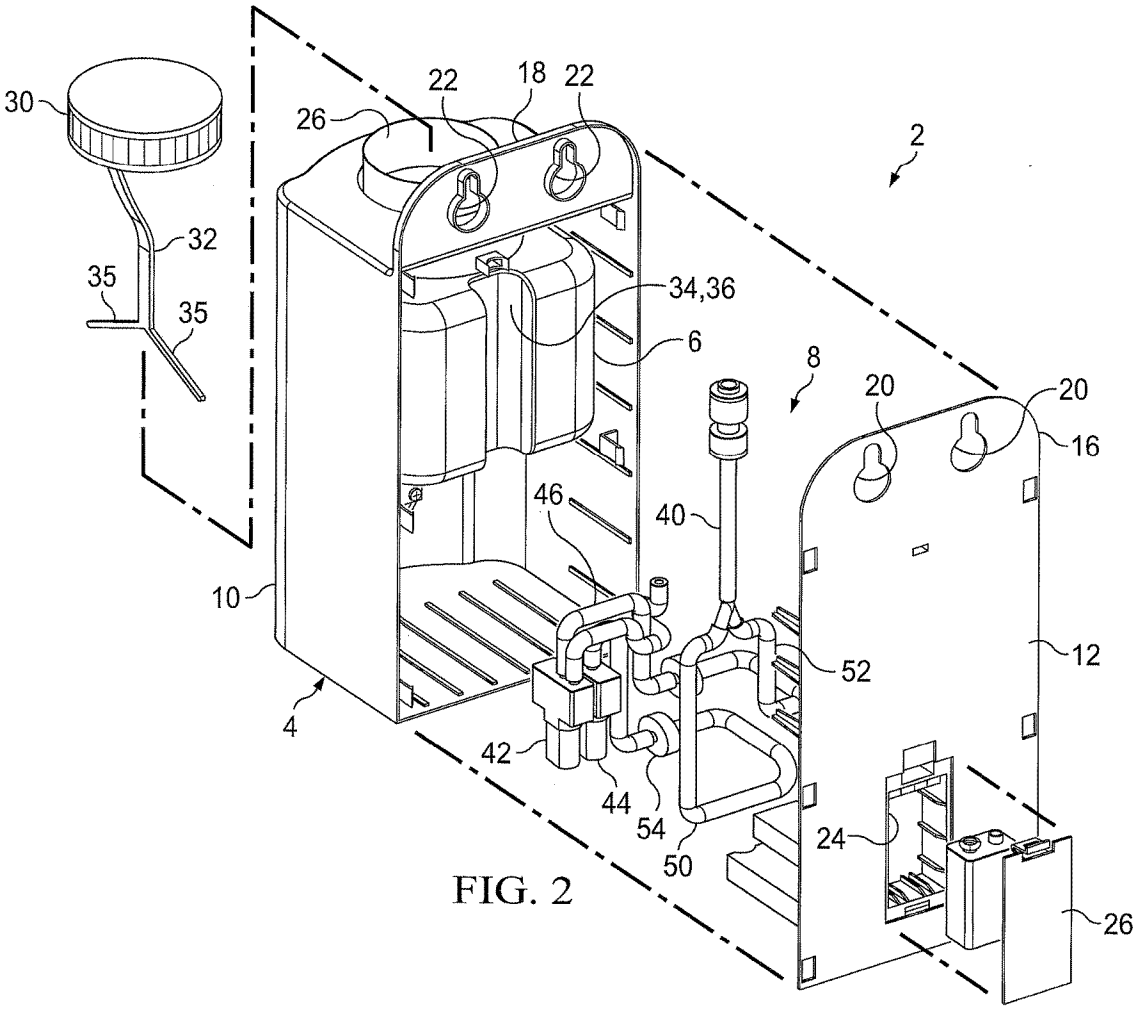
FIG. 2 is an exploded rear perspective view of the inventive dispenser apparatus 2.
Figure 3:
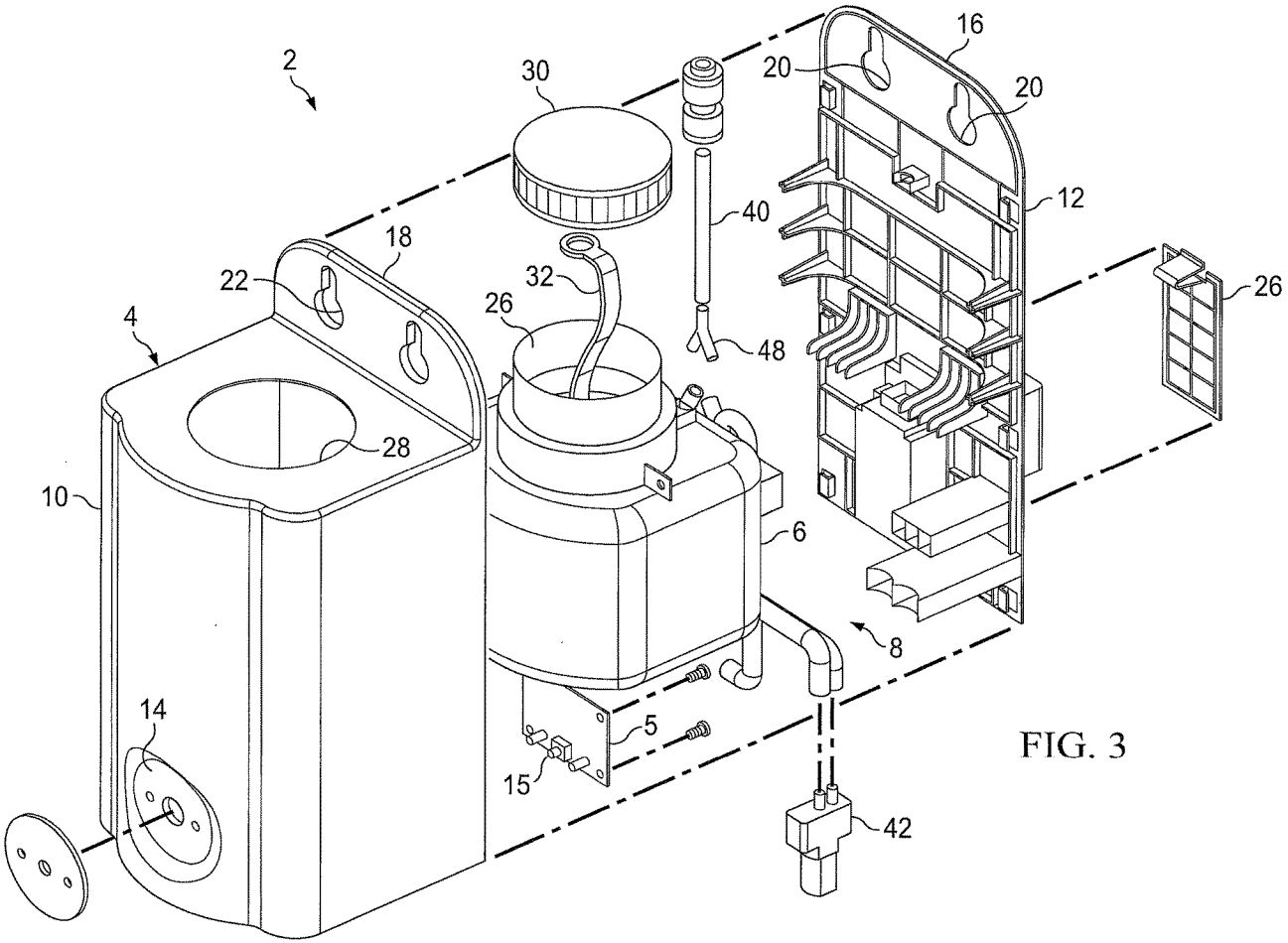
FIG. 3 is an exploded front perspective view of the inventive dispenser apparatus 2.

An embodiment 2 of the inventive dispenser apparatus is illustrated in FIGS. 1-3. The inventive dispenser 2 preferably comprises: a housing 4; a container 6 which is removably positionable within the housing 4 for holding a treatment liquid, a treatment liquid solution, or other treatment fluid; a delivery assembly 8 for delivering the treatment fluid from the container 6 to the condensation drainage line 9; and a control device (e.g., a circuit board having a microcontroller mounted thereon) 5 which is electronically linked to the delivery assembly 8.

The housing 4 preferably comprises (a) a hollow front piece 10 in which the container 6 and the delivery assembly 8 are received and (b) a back plate 12 which can be releasable secured to the back of the front piece of 10 for closing the housing 4. The hollow front piece 10 and the back plate 12 can be formed of injection molded HDPE or of any other material desired. A cutout 14 is provided in the front face of the hollow front piece 10 for receiving a button, switch, or other manual actuator 15 which is electronically linked, preferably by a wired or circuit connection, to the control device 5 for activating the inventive dispenser 2 to deliver a predetermined amount (i.e. a desired dose) of the treatment fluid to the condensation drainage line 9.

Corresponding mounting bracket pieces or extensions 16 and 18 are provided respectively at the upper end of the housing back plate 12 and at the upper end of the rear side of the housing front piece 10. The bracket extensions 16 and 18 have corresponding pairs of keyhole screw apertures 20 and 22 formed therethrough for mounting the inventive dispenser apparatus 2 on a wall, a wall stud, or other structure.

A battery compartment 24 and a removable cover 26 therefor are also preferably provided on the rear side of the housing back plate 12. It will be understood, however, that the inventive dispenser apparatus 2 can alternatively include a power cord for plugging the inventive apparatus 2 into an electrical outlet or can include or be connected to any other desired power source.

The container 6 which holds the treatment fluid can be formed of a transparent HDPE plastic or of any other desired material. The container 6 preferably also includes: a top opening 26 which will extend upwardly through a corresponding aperture 28 provided through the top of the housing front piece 10; a threaded cap 30 or other suitable closure for opening and closing the top opening 26 of the container 6; cap retention band 32 which is attached to the threaded cap 30 and has flexible retention legs 35 on the end thereof which are received and held in the container 6; and an upwardly extending exterior channel 34 which is formed in the back side 36 of the container 6 for receiving a treatment delivery line 40 of the delivery assembly 8 so that the treatment delivery line 40 is allowed to extend upwardly in the housing 4 through the exterior channel 34 of the container 6.

The treatment fluid used in the inventive apparatus can be any liquid, liquid solution, or other fluid which has been used heretofore, or which is otherwise effective, for disinfecting, cleaning, and/or clearing condensation drainage lines.

The delivery assembly 8 of the inventive dispenser apparatus 2 preferably comprises: a liquid pump 42; an air pump 44; a liquid pump inlet line 46 which extends from the bottom of the container 6 to the inlet of the liquid pump 42; a Y fitting 48 connected to the inlet end of the treatment fluid delivery line 40; a liquid discharge line 50 which extends from the discharge outlet of the liquid pump 42 to the Y fitting 48 for delivering the treatment fluid into the treatment delivery line 40; an air discharge line 52 which extends from the discharge outlet of the air pump 44 to the Y fitting 48 for delivering air into the treatment delivery line 40; a check valve or other back-flow preventer 54 provided in the liquid discharge line 50; and a check valve or other back-flow preventer 56 provided in the air discharge line 52.

By way of example, but not by way of limitation, the liquid pump 42 can be a 9 volt water/liquid pump with barb.

By way of example, but not by way of limitation, the air pump 44 can be a 9 volt air pump with barb.

The treatment delivery line 40, the liquid pump inlet line 46, the liquid pump discharge line 50, and the air discharge line 52 can each be formed of either a single length of conduit material (e.g., a length of flexible hose) or two or more segments of the conduit material connected in series by means of fittings, check valves, or other connectors. Each of the lines 40, 46, 50, and 52 will preferably be formed of one segment or a combination of two or more segments of ¼ inch flexible hose.

In accordance with the method of the present invention, the inventive dispenser apparatus 2 can be mounted in the user's garage or at any other convenient location on any floor or level of the user's home or building, either at, below, or above the elevation of the inlet end 7 of the air conditioner condensation drainage line 9. The treatment delivery line 40 extending from the top of the dispenser 2 will preferably be extended to the condensate drainage system such that the outlet end of the treatment delivery line 40 will be positioned either above, at, or inside the inlet end 7 of the condensation drainage line 9, or at any other desired location for delivering the treatment fluid from the inventive dispenser apparatus 2 into the condensation drainage line 9. By way of example, the treatment fluid delivery point 7 can be located in an attic or upper floor 11 of a building and the dispenser apparatus 2 can optionally be mounted in a different floor 13 of the building which is elevationally lower than the attic or upper floor 11.

It will be understood that although only one treatment fluid delivery point 7 for the condensation drainage line 9 is illustrated in FIG. 1, the inventive apparatus 2 could alternatively have two or more treatment delivery lines 40 which (a) extend to multiple different delivery points 7 for the drainage line 9 or (b) extend to different delivery points 7 for multiple different condensation and/or other drainage lines 2.

At any desired time after the inventive dispenser apparatus 2 is installed, the liquid pump 42 can be activated to pump a predetermined amount or other desired amount of the treatment fluid from the treatment fluid container 6 into the treatment delivery line 40. Next, preferably following a slight delay of 30 seconds or less, the air pump 44 is activated to deliver a sufficient amount, preferably a burst, of air at a sufficient pressure to push the dose of the treatment fluid through the treatment delivery line 40 and into the condensation drainage line 9.

These operations will preferably be performed by the system control device 5. The control device 5 can be, for example, a circuit board having a micro-controller mounted thereon which is in electronic communication with the liquid pump 42 and the air pump 44. The micro-controller will preferably be programmed so that, when the user presses the actuator button 15, the control device 5 will then automatically operate to (a) activate the liquid pump 42 to deliver a predetermined amount of the treatment fluid from the container 6 to the treatment delivery line 40 and then subsequently (b) activate the air pump 44 to discharge a sufficient amount of air at a sufficient pressure into the treatment delivery line 40 to push the dose of treatment fluid through the treatment delivery line 40 and into the condensation drainage line 9.

Alternatively or in addition, the control device or system 5 of the inventive dispenser apparatus 2 can be an app enabled system 60 which allows the user to program, reprogram, monitor, and/or remotely activate the inventive dispenser apparatus 2 using an IPHONE, a smart phone, an IPAD, a tablet, any other app enabled hand held device, a computer, or any other such app enabled wireless device 80. The components of the app enabled control system 60 for the inventive dispenser 2 can comprise separate modules, chips, or other units which are electronically linked together in any way desired. More preferably, some or all of the components of the control system will be part of an integrated circuit system or otherwise located together and electronically linked, for example, on a single circuit board. It will also be understood that some functions of the inventive app enabled control system 60 for the dispenser apparatus 2 can be performed by a Web-based cloud server and/or by the user's smart phone or other app enabled wireless device 80.

Figure 4:
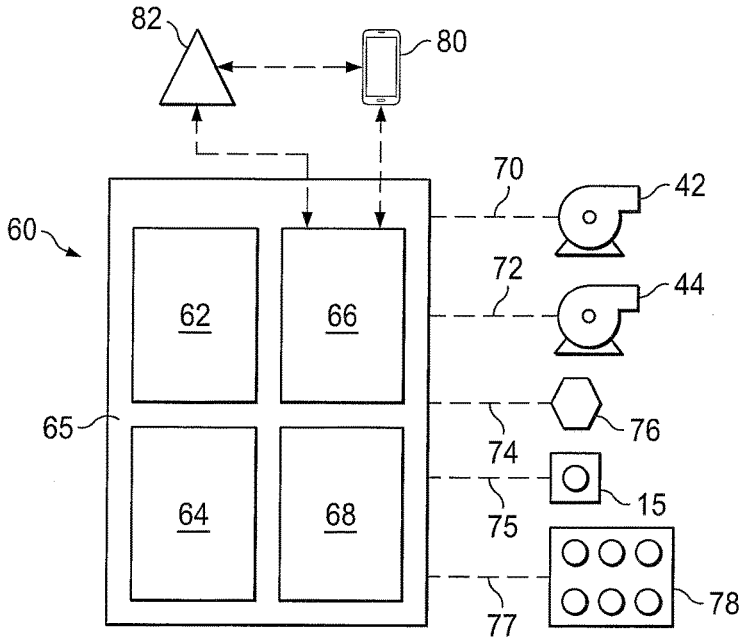
FIG. 4 schematically illustrates a control system 60 for the inventive dispenser apparatus 2.

An example of an app enabled control system 60 for the inventive dispenser apparatus 2 is illustrated in FIG. 4. The control system 60 comprises: a microprocessor or other processing unit 62; a computer readable medium or other storage component 64 on which the operational instructions (i.e., the program code) for the dispenser apparatus 2 are stored, and which can be read by the processing unit 62; a Wi-Fi communication component 66; and a clock component 68. The control system 60 provided in the inventive dispenser apparatus 2 preferably comprises a circuit board 65 having a wireless integrated circuit thereon with embedded firmware (e.g., flash memory) and wireless Wi-Fi capability. Most preferably, the control system 60 comprises comprise a 32 bit ARM® microcontroller unit (MCU) such as a STM32 microcontroller.

As also illustrated in FIG. 4, the processing unit 62 of the control system 60 is electronically linked to the components of the dispenser apparatus 2 for (a) sending an activation signal 70 to the liquid pump 42, (b) sending an activation signal 72 to the air pump 44, (c) receiving a signal 74 from a sensing device 76 indicating the level or amount of treatment fluid remaining in the container 6, (d) receiving a manual activation signal 75 from the manual actuator 15, and/or (d) receiving entry information 77 from an optional key pad or other manual entry device 78 on the dispenser apparatus 2 for programming or reprogramming the treatment regimen performed by the inventive apparatus 2.

In addition, as further illustrated in FIG. 4, the wireless Wi-Fi capability of the control system 60 allows the inventive dispenser apparatus 2 to communicate with the user's IPHONE, smart phone, IPAD, tablet, a computer, or other app enabled device 80 through either the Internet 82 or directly through the user's home router. Consequently, by downloading an app provided for the inventive dispenser apparatus 2, the user's smart phone, tablet, computer or other app enabled device 80 can be used, for example, to remotely activate a treatment, enter or change the time or frequency of automatic treatments for a scheduled treatment program, enter or change the amount of treatment fluid used per treatment, enter or change the amount of time between the activation of the liquid pump 42 and the air pump 44, check the level or amount of treatment fluid remaining in the container 6, enter or change individual treatment points or amounts in a multiple treatment point program, etc.

Although the inventive control system 60 has been described as communicating with an app enabled device 80 via Wi-Fi, it will be understood that the inventive control system 60 can alternatively be configured to communicate with the user's smart phone, tablet, or computer, or with a remote control or other hand-held device, via radio frequency, infrared, Bluetooth, or other wireless communication modes.

Figure 5:
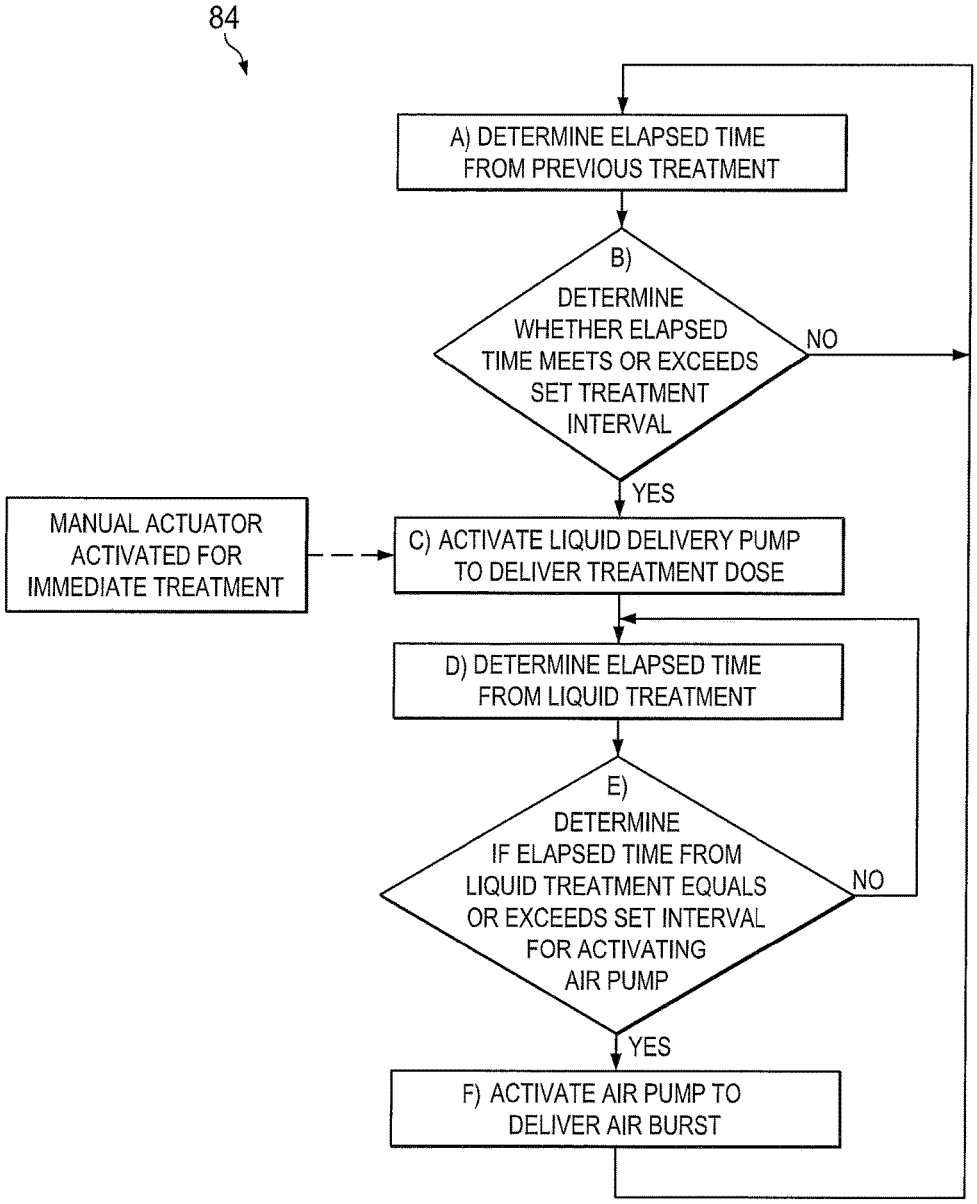
FIG. 5 is a flow chart illustrating a programmed operating procedure 84 embodied in a computer readable storage component 64 of the control system 60.
Figure 7:
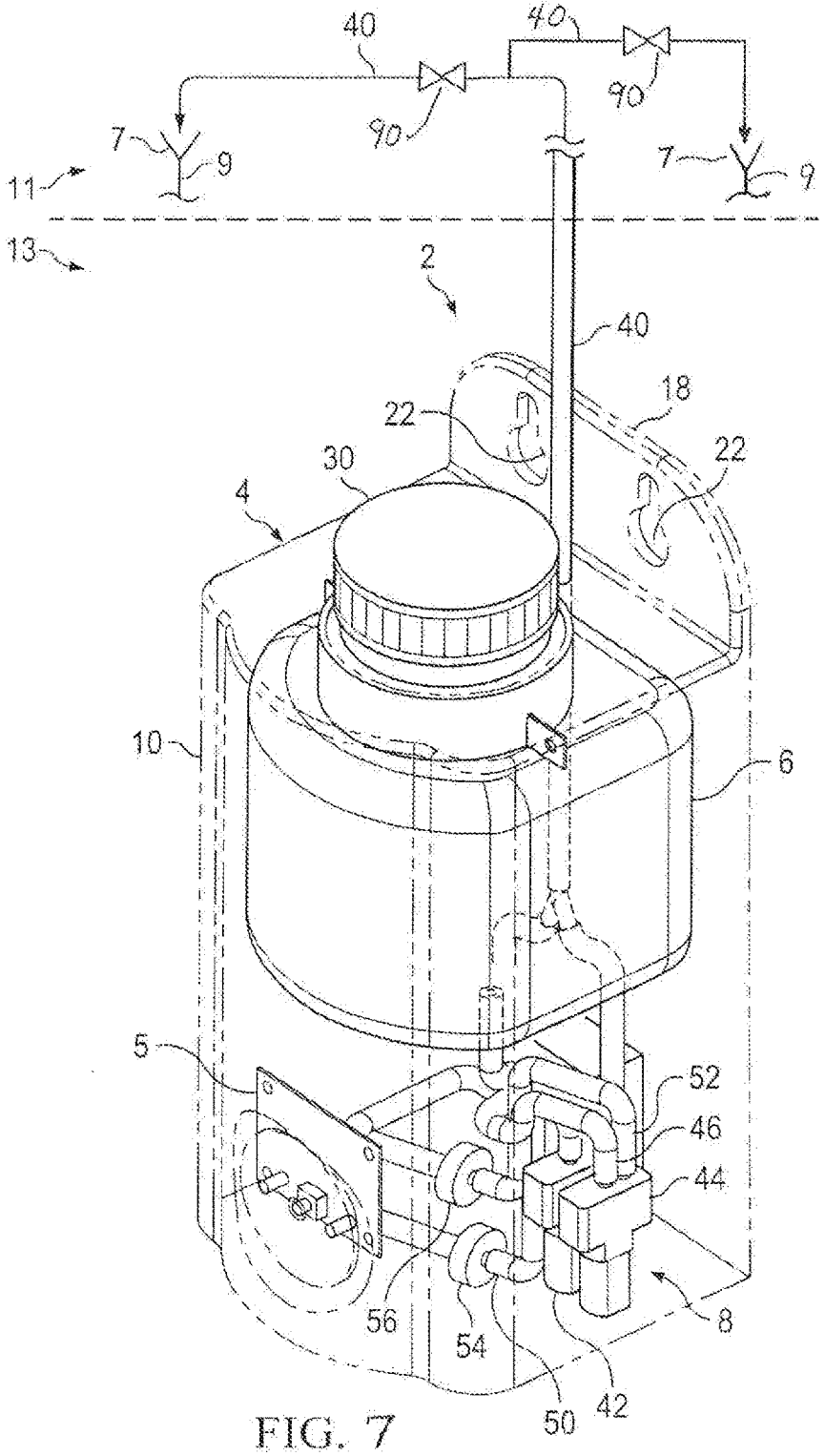
FIG. 7 is a front perspective view of an embodiment of the inventive dispenser apparatus having a plurality of treatment delivery lines 40 which extend to delivery points 7 for a plurality of different condensation and/or drainage lines 9.

By way of example, but not by way of limitation, a program code 84 for the inventive dispensing apparatus 2 is illustrated in FIG. 5. The program code 84 will preferably be stored on the computer readable medium or other storage component 64 of the control system 60. In accordance with the steps shown in FIG. 5, the program code 84 causes the control system 60 to (a) determine an elapsed time from a previous treatment of the condensate drainage line 9 in question, (b) determine if the amount of elapsed time determined in the previous step equals or exceeds a programmed time interval for automatic treatment of the condensate drainage line 9, (c) if so, activate the liquid pump 42 for an interval necessary to deliver a programmed amount (i.e., dose) of treatment fluid into the treatment delivery line 40, (d) determine an elapsed time from the beginning or end of the activation interval of the liquid pump 42, (e) determine if the elapsed time since the beginning or end of the activation interval of the liquid pump 42 equals or exceeds a programmed time interval for activation of the air pump 44, (f) if so, activate the air pump 44 to discharge an air burst into the treatment delivery line 40 to push the treatment fluid previously delivered into the line 40 by the liquid pump 42 out of the line 40 and into the condensate drainage line 9, and then return to step (a).

On the other hand, if the user activates the manual actuator 15 on the dispenser apparatus 2 or enters a command on the user's smart phone or other app enabled wireless device 80 that a treatment be immediately performed, the programmed code 84 causes the control system 62 to immediately moved to step (c) of the programmed procedure. After performing step (c), the control system automatically also procedures with the subsequent programmed steps (d)-(f) and then returns to step (a).

Figure 6:
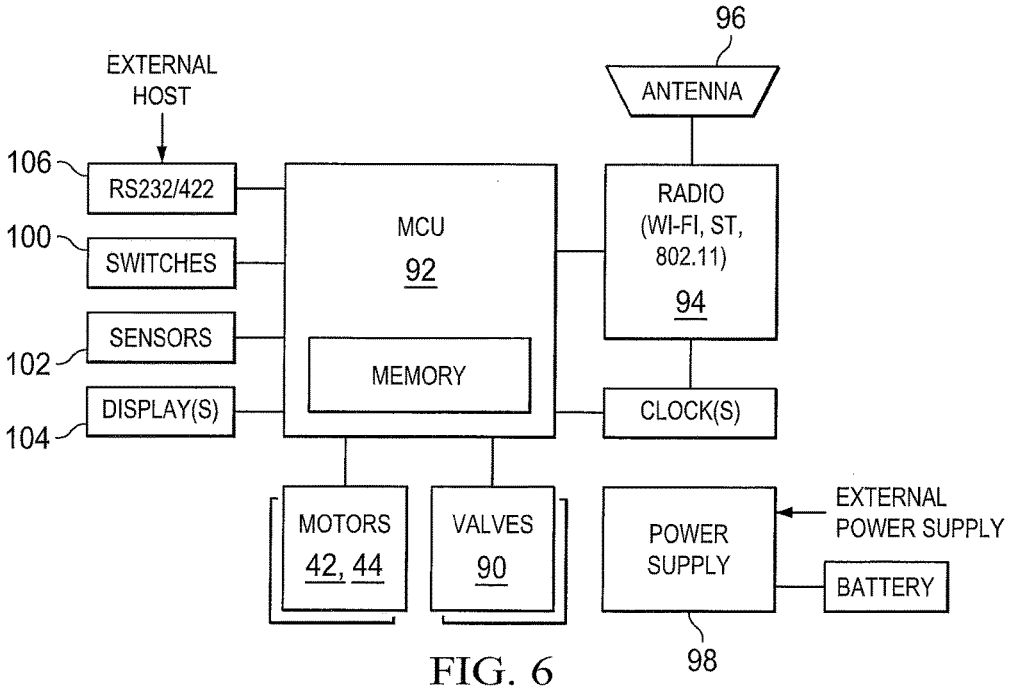
FIG. 6 also illustrates an embodiment of the control system of the inventive wireless programmable dispenser.

An embodiment of the control system for the inventive Wireless Programmable Dispenser is also illustrated in FIG. 6.

The dispenser contains air and fluid pumps 42, 44 and valves 90 for controlling fluid flow and delivery. The system is capable of delivering fluid through one or multiple output ports. The pumps 42, 44 and valves 90 are controlled by a circuit board consisting of an MCU 92 with embedded firmware, memories, a radio subsystem 94 with on-board or external antenna 96, and power supply 98. The system can be controlled by the user via a local interface consisting of switches 100 and sensors 102, and status information is relayed to the user via display(s) and/or LEDs 104. The user can control the fluid amount to be delivered with each cycle, the air pump duration for delivering the fluid, the time duration between cycles, and other controls necessary for system operation. The status information is the current settings of control, fluid levels, fluid delivery times, system status, and other information about the system status and operation.

The system also has provisions for remote control via either a radio subsystem 94 (Wi-Fi, Bluetooth, IEEE 802.11 or similar), or a serial control interface 106 (for example RS232 or RS422). System control and status information is exchanged with a remote host via the radio 94 or serial interface 106. The host is a computing device with a compatible radio or serial data interface such as a PC, dedicated computing platform, cell phone or tablet device running application code that is capable of sending and receiving control and status information with the device.

Thus, the present invention is well adapted to carry out the objects and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within this invention as defined by the claims.

What is claimed is:

1. A dispenser apparatus for treating condensation drainage lines comprising:

a container for a treatment fluid, a plurality of treatment delivery lines for delivering the treatment fluid to a plurality of different treatment points in one or more condensation drainage lines, a liquid pump having an inlet for receiving said treatment fluid from said container, said liquid pump also having a discharge for delivering said treatment fluid to said treatment delivery lines, an air pump having a discharge line for delivering air to said treatment delivery lines, and a control device which (i) is electronically linked to valves in said treatment delivery lines to individually select one of said treatment points for treatment, (ii) is electronically linked to said liquid pump to activate said liquid pump to deliver a dose of said treatment fluid for said selected one of said treatment points, and (iii) is electronically linked to said air pump to automatically activate said air pump to deliver a burst of air to push said dose of said treatment fluid to said selected one of said treatment points, wherein at least one of said treatment delivery lines has an upwardly extending portion which retains an amount of said treatment fluid when said treatment fluid is delivered into said at least one treatment delivery line by said liquid pump, and said air pump being sized and configured to push said treatment fluid out of said upwardly extending portion of said at least one treatment delivery line.

2. The dispenser apparatus of claim 1 further comprising:

a check valve installed in said liquid pump discharge and a check valve installed in said discharge line of said air pump.

3. The dispenser apparatus of claim 2 further comprising said liquid pump discharge and said discharge line of said air pump being connected to a Y fitting upstream of said treatment delivery lines.

4. The dispenser apparatus of claim 3 wherein said container has an upwardly extending exterior channel formed in a side thereof which extends from a bottom of the side to a top of the side and wherein a treatment delivery line for the treatment fluid and the air extends upwardly in said housing from said Y fitting through said upwardly extending exterior channel formed in said container.

5. The dispenser apparatus of claim 1 wherein said control device has programmed instructions stored therein such that said control device will operate to (a) select one of the treatment points for treatment, (b) activate said liquid pump to deliver said dose of said treatment fluid for said selected on of said treatment points and then (c) stop said liquid pump and then (d) activate said air pump to discharge said burst of air to push said dose of said treatment fluid to said selected one of said treatment points.

6. The dispenser apparatus of claim 5 further comprising a manual actuator electronically linked to said control device to cause said control device to operate in accordance with said programmed instructions.

7. The dispenser apparatus of claim 1 further comprising a housing, wherein:

said container is positioned in said housing and said liquid pump and said air pump are positioned in said housing beneath said container.

8. The dispenser apparatus of claim 1 wherein said control device is a control system comprising:

a processing unit;

a program code which is embodied on a computer readable storage component and is readable by the processing unit; and a Wi-Fi communication component providing wireless communication between said control system and an app enabled smart phone or other app enabled wireless device.

9. The dispenser apparatus of claim 8 wherein, in accordance with said program code embodied on said computer readable storage medium, an activation signal can be communicated from said app enabled wireless device to said control system which will specify said selected one of the treatment delivery points and will cause said control device to (a) activate said liquid pump to deliver said dose of said treatment fluid for said selected one of said treatment points and then (b) stop said liquid pump and then (c) activate said air pump to discharge said burst of air to push said dose of said treatment fluid to said selected one of said treatment points.

10. The dispenser apparatus of claim 8 wherein said program code comprises programmed steps readable by said processing unit to cause said control system to automatically (a) determine an elapsed time from a previous treatment of said one or more condensate drainage lines, then (b) determine if said elapsed time from said previous treatment equals or exceeds a programmed time interval for automatic retreatment of said one or more condensate drainage lines, then (c) if so, activate said liquid pump for an interval necessary to deliver said dose of said treatment fluid for a selected one of said treatment points, then (d) activate said air pump to deliver said burst of air, and then return to step (a).

11. The dispenser apparatus of claim 10 wherein in accordance with the program code embodied on the computer readable storage medium, said app enabled wireless device can be used to remotely: set or change an amount of said dose of said treatment fluid; set or change said programmed time interval for automatic retreatment of said one or more condensate drainage lines; and/or set or change a time interval between step (c) for activating said liquid pump to deliver said dose of said treatment fluid and step (d) for activating said air pump to deliver said burst of air.

12. The dispenser apparatus of claim 8 wherein:

said control system is electronically linked to a sensor which delivers a signal to said control system indicating a level or amount of said treatment fluid in said container and in accordance with said program code embodied on the computer readable storage medium, said control system communicates said level or amount of said treatment fluid in said container to said app enabled wireless device.

* * * * *